United States Patent [19]

Lindeberg

[11] 3,936,781

[45] Feb. 3, 1976

[54] SELECTING DEVICE FOR CROSSBAR SWITCHES

[75] Inventor: Sven-Erik Lindeberg, Huddinge, Sweden

[73] Assignee: Telefonaktiebolaget L M Ericsson, Stockholm, Sweden

[22] Filed: Sept. 5, 1974

[21] Appl. No.: 503,340

[30] Foreign Application Priority Data

Sept. 18, 1973 Sweden ..... 7312665

[52] U.S. Cl. ..... 335/112; 200/175; 200/178

[51] Int. Cl.[2] ..... H01H 67/04

[58] Field of Search ..... 335/112; 200/175, 176, 200/177, 178, 114

[56] References Cited

UNITED STATES PATENTS

| | | | |
|---|---|---|---|
| 2,120,408 | 6/1938 | Hickman | 200/177 |
| 2,120,413 | 6/1938 | Matthies | 200/177 |
| 3,445,795 | 5/1969 | Holtfreter et al. | 335/112 |
| 3,673,366 | 6/1972 | Symes | 335/112 |

*Primary Examiner*—Harold Broome

*Attorney, Agent, or Firm*—Hane, Baxley & Spiecens

[57] ABSTRACT

Selecting device for crossbar switches of the type where selecting wires are actuated by selecting bars, which execute twisting movements by means of selecting bar magnets, for selection of predetermined contact groups. After selection, these contact groups can be actuated by lifting devices, which move in a direction mainly parallel to the selecting bars, on operation of bridge magnets, due to transfer of the movements of the lifting device to the contact groups via the actuated selecting wires. According to the invention the selecting wires are flexible and bent to a symmetrical loop with two legs. Each selecting wire is movably supported in such a manner that it encircles the respective selecting bar and the legs can swing around an axis mainly parallel to said axis of rotation of the selecting bar. Inner and outer stops are arranged such that the legs, when not actuated, rest against the inner stops and, when actuated, are pressed against the outer stops. For actuation of the selecting wires the selecting bars are provided with selecting wings which in the uninfluenced condition occupy a position midway between the legs of the respective selecting wires, when the latter rest against the inner stops.

10 Claims, 7 Drawing Figures

SELECTING DEVICE FOR CROSSBAR SWITCHES

The present invention relates to a selecting device for crossbar switches. In this type of switches, selecting wires are used, which are actuated by selecting bars which execute twisting movements in two directions around a neutral position by the action of selecting bar magnets. When actuated, the selecting wires will then be able to transfer the movements of lifting devices, which are actuated by bridge magnets, to thus selected contact groups as they are being pressed against the lifting mechanisms of the contact groups by the lifting devices. The selecting wires are kept in this position as long as the respective bridge magnets are actuated but by being elastically attached to the selecting bars they enable the latter to execute twisting movements independent of the position of the selecting wires.

The selecting wires are usually made from thin wires of flexible material, for example musical string wire, which are wound in their fastening end to form coil springs and fixed to the selecting bars. This simple form presents above all two problems. One is that the selecting wires, when returning to neutral position, execute heavy oscillations which have to subside to a certain permissible amplitude before a new bridge operation can be allowed to occur. A number of solutions to this problem have been proposed, compare for example the Swedish Pat. No. 155,336. The other problem is that the selecting wires demand very careful adjustment for occupying the right position relative to the lifting mechanisms of the contact groups. The U.S. Pat. No. 3,445,795 discloses a solution of this problem by introducing double selecting wires which are mounted in such a manner that their free ends are turned towards the selecting bars and are acted upon by selecting wings applied on the selecting bars. In the neutral position the selecting wires are unaffected by the selecting bars and then rest against inner stops applied between the legs of the selecting wires. When acted upon one leg of the wires is being bent out against outer stops while simultaneously sliding against guides which reach between the inner and the outer stops. By this arrangement said adjustment problem is indeed eliminated but the arrangement demands fairly large angular motion of the selecting bars. The great angular motion is caused by the fact that the selecting wings must act on the outer ends of the respective legs while the effective bending occurs closer to the fastening end. This arrangement requires that the arrangement is difficult to adapt to earlier designs without radical construction changes.

The present invention solves said problem by means of double selecting wires which are so mounted that their free ends are turned away from the selecting bars and so that their legs are acted on closer to their fastening end by selecting wings on the selecting bars. The effective bending occurs at the outer ends of the legs and therefore the selecting bars only need to execute relatively small angular movements. The arrangement is very easy to incorporate in crossbar switches of earlier design with single selecting wires.

The characteristics of the invention appear from the claims.

The invention will be described by an embodiment with the aid of the enclosed drawings where FIG. 1 – 3 in simplified form show the details necessary for description of the operation in three different operating conditions, FIG. 4A shows an elevational side view of the double selecting wire in two projections;

Figure 1:
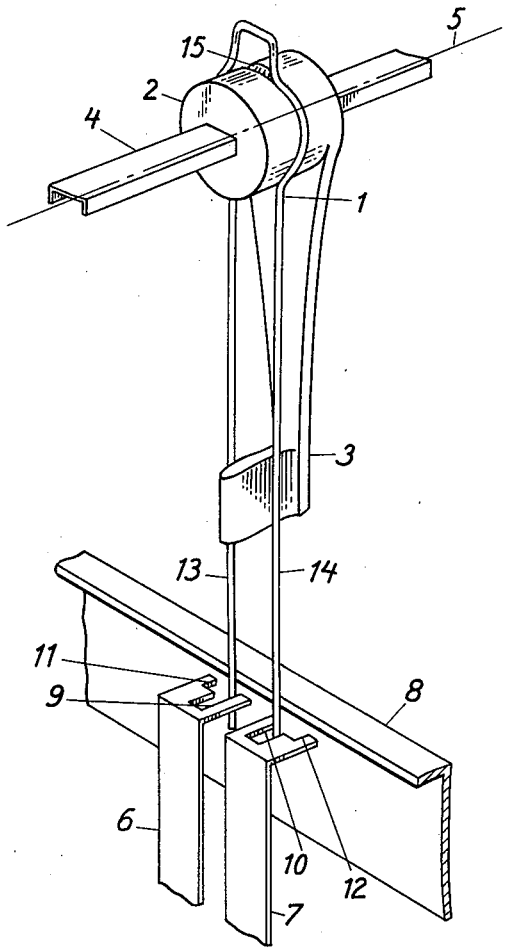

FIG. 1 shows a selecting wire 1 mounted on a supporting arrangement 2, which according to the example is combined with a selecting wing 3. The supporting arrangement is fixed to the selecting bar 4, shown only in part, which by means of the not shown selecting bar magnets can be turned about the axis of rotation 5. Furthermore are shown in FIG. 1 two lift springs 6, 7 belonging to those contact groups which are to be operated by a lifting device 8 on actuation of the not shown bridge magnet. According to the embodiment shown, the ends of the lift springs have flanges *6a* and *7a* in a direction towards the lifting device 8 and provided with notches, the boundary surfaces of which form a pair of inner stops 9, 10 and a pair of outer stops 11, 12 provided for the legs 13, 14 of the selecting wire. The selecting bar 4 is in its neutral position in which the selecting wing 3 is centered between the legs 13, 14. The legs then rest against the inner stops 9, 10 and against the lifting device 8 while exerting a certain spring pressure owing to the shape of the selecting wire as will be explained later.

Figure 2:
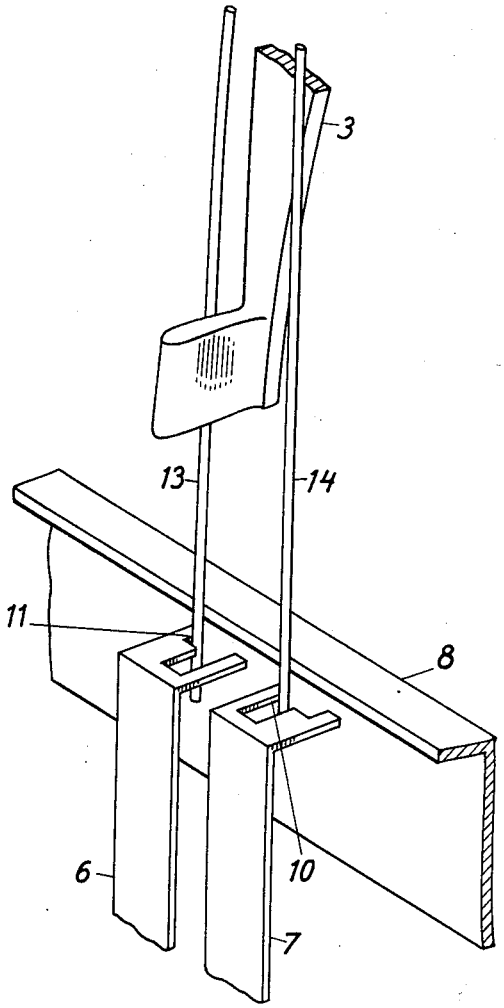

Small twisting movements of the selecting bar are possible without the selecting wire being influenced, as the selecting wire 1 can slide in the circular groove 15 in the supporting arrangement 2. A completed turn of the selecting bar in one direction causes the selecting wing 3 to move the corresponding leg, for example 13, of the selecting wire outwards so that it leaves its inner stop 9 and instead is pressed towards its outer stop 11. This condition is shown in FIG. 2 from which also appears that the leg 13 has become somewhat bent owing to a certain excess movement of the selecting wing. The other leg 14 still lies in its previous position but the pressure against the stop 10 is now somewhat harder owing to the separation of the legs.

Figure 3:
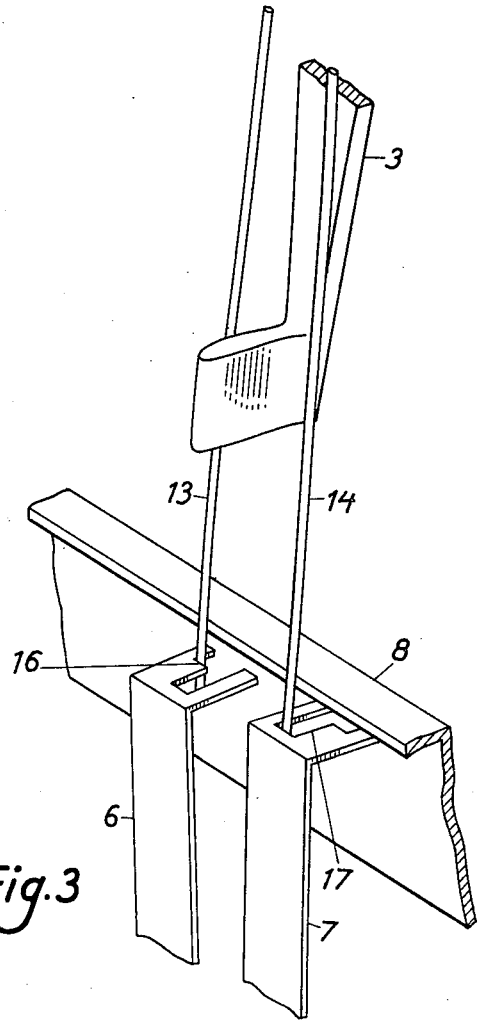

FIG. 3 shows the next step in which, by a tilting movement, the lifting device 8 has been pressed towards the two legs 13, 14 of the selecting wires so that they are bent out in a direction towards the lift springs 6, 7. During this movement the leg 13 is caught by a shoulder 16 associated with the outer stop 11 whereby the lift spring 6 is forced to follow the movement of the lifting device and the corresponding, not shown, contact group is operated. The leg 14 on the contrary can move freely in the notch 17 whereby the lift spring 7 remains in its original position. By friction the leg 13 is kept in position against the shoulder 16 even if the selecting bar returns to the neutral position and even executes new turning movements. In such case, furthermore, the leg 14 is prevented from being moved towards the outer stop 12 when acted upon by the selecting wing, owing to the notch 17.

When the lifting device 8 returns to its original position the two legs of the selecting wire also return while simultaneously bearing on the lifting device whereby the energy stored in the spring is completely absorbed through the frictional forces and the oscillations of the legs are rapidly fading out.

Figure 4A:
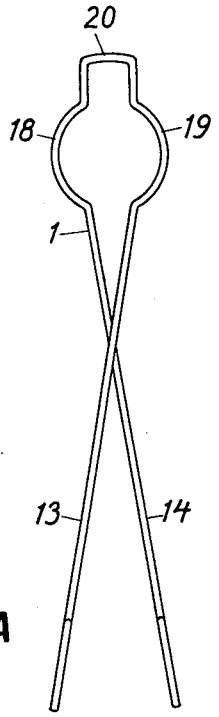
FIG. 4B shows an edge view of FIG. 4A.
Figure 4B:
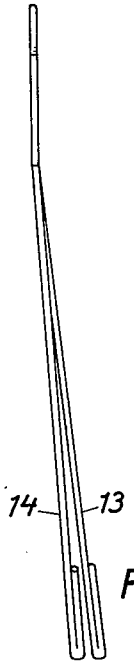

FIGS. 4A and 4B show an example of how the selecting wire 1 can be constructed. It is made from a thin wire of flexible material, for example highly flexible wire, which is bent to a loop shape with two straight legs 13, 14 which are connected via two bow-shaped parts 18, 19 and a loop-shaped projection 20. From the above functional description it appears that the active leg, in this case 13, is subject to a certain bending stress in the direction of movement of the lifting device when it is pressed against the shoulder 16 by the lifting device 8. In order to provide the legs with greater resistance against this bending their outer ends are stiffened. This can, for example as is shown in FIG. 4, be achieved by double folding the outer ends 13A and 14A. From the figure also appears that the legs of the selecting wire are so bent that, in the non-mounted condition, they cross each other and further form an angle with a plane through the bow-shaped parts and the loop-shaped projection. This shape serves to create a certain stress in the legs when mounted on the supporting arrangement 2, so that a spring pressure is obtained against the inner stops 9, 10 as well as the lifting device 8.

Figure 5A:
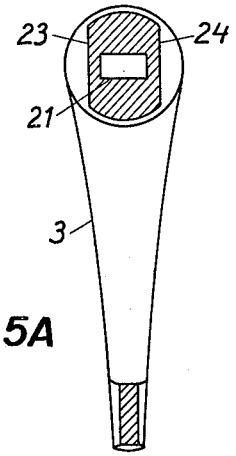
FIG. 5A shows an elevational sectional view of a selecting wing taken on line A—A of FIG. 5B.
Figure 5B:
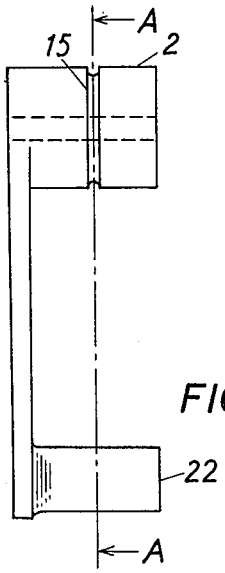
FIG. 5B shows a side view of FIG. 5A.

FIGS. 5A and 5B show an example of how a combined supporting arrangement 2 and selecting wing 3 can be made. The supporting arrangement consists of a hub with circular cross section, with a groove 15 in which the bow-shaped parts 18, 19 (FIGS. 4A and 4B) of the selecting wire can slide and a through hole 21 for mounting of the arrangement 2 on the selecting bar 4 (FIG. 1). Radially projecting from one end of the hub is the selecting wing 3, which is provided with a finger 22 to actuate the legs 13, 14 of the selecting wire (FIG. 1 – 3). According to the example the groove 15 is provided with two straight portions 23, 24 parallel to the selecting wing. The purpose of these portions is to simplify the mounting of the selecting wire thereby, that the straight portions have such mutual distance that the legs of the selecting wire are guided in between the inner and outer stops 9, 10 and 11, 12 respectively (FIG. 1). The loop-shaped projection 20 (FIG. 4A) of the selecting wire is also intended to simplify the mounting by serving as a grip for a tool.

I claim:

1. In a selecting device for crossbar switches of the type in which selecting wires are actuated by selecting bars performing turning movements about an axis of rotation by the action of selecting bar magnets for selection of predetermined contact groups whereby said contact groups can be actuated by lifting devices, moving in a direction substantially parallel to the selecting bars, on operation of bridge magnets, due to transfer of the movements of the lifting devices to the contact groups via the actuated selecting wires, the improvements comprising selecting wires made of flexible material shaped in a plane to form a symmetrical loop form with two legs, said wires being movably supported in such a manner that each of said selecting bars is encircled by bent ends of the appertaining selecting wires and so that said legs of the selecting wires are swingable in said plane about an axis which is substantially parallel to said axis of rotation of said selecting bar, inner stops and outer stops being arranged adjacent to said selecting wires, whereby, when inactive, said legs of said selecting wires are arranged to rest against said inner stops situated between said legs and by bending-out to be brought into contact with said outer stops lying outside said legs and each of said selecting bars being provided with a selecting wing adjacent to each selecting wire, which, when the respective selecting bar is in the inactive condition, is arranged to occupy a position midway between said legs of the respective selecting wire when they rest against said inner stops, and by rotation of said selecting bar to lift one of said legs to engage the respective one of said outer stops, whereby said selecting wire is exposed to elastic deformation.

2. Selecting device according to claim 1, said selecting wires, when mounted, being prestressed in said plane thereby providing elastic bearing at said inner stops.

3. Selecting device according to claim 1, said selecting wires, when mounted, being prestressed perpendicular to said plane thereby providing elastic bearing at said lifting devices.

4. Selecting device according to claim 1, said selecting wire being shaped in the form circular bows with a predetermined radius of curvature from which said legs protrude at an angle such that, when not mounted, they have a crossing direction.

5. Selecting device according to claim 1, in which, for movable support of said selecting wires, supporting arrangements being provided with circular bow-shaped grooves engageable with correspondingly shaped portions of the selecting wires, by which arrangement the selecting wires can encircle said grooves and execute rotational movements by sliding in the grooves.

6. Selecting device according to claim 1, said selecting wires being shaped in the form of a loop-shaped projection to facilitate mounting.

7. Selecting device according to claim 1, said legs of the selecting wires being provided with stiffenings at their outer ends arranged to increase the resistance of the legs against bending during said transfer of said movements of said lifting devices to said contact groups.

8. Selecting device according to claim 5, said supporting arrangements being supported by the respective selecting bar.

9. Selecting device according to claim 8, each of said bearing arrangements and said selecting wings constituting a combined fixed unit.

10. Selecting device according to claim 5, said grooves of said supporting arrangements each having a pair of straight portions, substantially parallel to the selecting wings, which are arranged to guide the corresponding selecting wire when mounting.

* * * * *